US005996508A

United States Patent [19]

Constantino et al.

[11] Patent Number: 5,996,508

[45] Date of Patent: Dec. 7, 1999

[54] PLASTIC PALLET

[75] Inventors: James Paul Constantino, Mt. Clemens; Raymond Harold Gosnell, Plymouth; Richard Alan Jordan, Mt. Clemens; James William Jacoby, Jr., Rochester Hills, all of Mich.

[73] Assignee: Cadillac Products, Inc., Troy, Mich.

[21] Appl. No.: 08/445,660

[22] Filed: May 22, 1995

Related U.S. Application Data

[63] Continuation of application No. 08/125,149, Sep. 23, 1993, abandoned, which is a continuation of application No. 07/975,805, Nov. 13, 1992, abandoned.

[51] Int. Cl.[6] ..... B65D 19/00

[52] U.S. Cl. ..... 108/51.1; 108/53.1

[58] Field of Search ..... 108/901, 51.1, 108/53.1, 55.3

[56] References Cited

U.S. PATENT DOCUMENTS

| | | | |
|---|---|---|---|
| 1,784,511 | 12/1930 | Carns . | |
| 3,164,110 | 1/1965 | Bofinger . | |
| 3,187,691 | 6/1965 | Leitzel . | |
| 3,267,883 | 8/1966 | Vissers . | |
| 3,583,036 | 6/1971 | Brown . | |
| 3,610,173 | 10/1971 | McIlwraith et al. . | |
| 3,691,964 | 9/1972 | Larson et al. . | |
| 3,925,140 | 12/1975 | Brown . | |
| 4,000,704 | 1/1977 | Griffin, Jr. | 108/51.1 |
| 4,428,306 | 1/1984 | Dresen et al. . | |
| 4,606,278 | 8/1986 | Shuert . | |
| 4,879,956 | 11/1989 | Shuert . | |
| 5,391,251 | 2/1995 | Shuert . | |

FOREIGN PATENT DOCUMENTS

| | | | |
|---|---|---|---|
| 0305082 | 3/1989 | European Pat. Off. | 108/51.1 |

*Primary Examiner*—Michael J. Milano
*Attorney, Agent, or Firm*—Brooks & Kushman PC

[57] ABSTRACT

A plastic pallet has improved strength characteristics by the use of bosses arranged so as to avoid forming hinge lines in the deck. The arrangement is generally non-symmetrical about any axis of the deck. The bosses can be of varying sizes and varying depth.

5 Claims, 5 Drawing Sheets

PLASTIC PALLET

This is a continuation/division of U.S. patent application Ser. No. 08/125,149, filed Sep. 23, 1993 now abandoned. which is a continuation/division of U.S. patent application Ser. No. 07/975,805, filed Nov. 13,1992 entitled PLASTIC PALLET now abandoned.

BACKGROUND OF THE INVENTION

This invention relates to pallets for use in transporting and storing goods. More particularly, the invention relates to twin sheet thermoformed plastic pallets having increased load handling capabilities.

Pallets have been constructed of various materials including wood, steel, and plastic. Wood pallets have problems of inadequate strength and limited life expectancy in use. Steel pallets, while having increased strength characteristics, are not suited to wet or corrosive environments. Both wood and steel pallets can be of considerable weight and neither are easily recycled, resulting in an additional cost for disposal at the end of their useful life.

Plastic pallets have been gaining increased acceptance due to factors such as the high strength to weight ratio, resistance to corrosion, and durability. While numerous techniques for producing plastic pallets are known, it has become increasingly popular to thermoform plastic pallets especially with the technique known as twin sheet thermoforming as discussed in U.S. Pat. Nos. 3,583,036 to Brown, 3,787,158 to Brown, and 3,925,140 to Brown.

Twin sheet plastic pallets are designed to take maximum advantage of the materials used. Efforts have been to maximize the load carrying capacity of the pallet, namely to meet its expected use by maximizing the load capacity for the given amount of material used in forming the pallet. The prior art contains pallets having linearly extending channels or ribs which are formed into the pallet to increase stiffness, see e.g. U.S. Pat. No. 3,187,691. These ribs or channels can have an undesirable effect of allowing bending or hinge moments to occur along the length of the rib, i.e. the material may flex about an axis determined by the length of the rib or channel. Attempts to counteract this have been to place parallel linear channels in one surface of the deck and a series of parallel channels running at an angle to the first series of channels in the lower surface of the deck, e.g. U.S. Pat. No. 3,610,173. Other efforts to increase the structural strength of the pallet have included use of non-linear protuberances or bosses formed in repeating symmetrical arrangements across the surface of the deck. The bosses do not have a substantially linear component in the surface of the deck and therefore no single boss makes a significant contribution to a bending or hinge moment across that single boss. See, e.g. U.S. Pat. No. 4,879,956.

Summary of the Invention

The invention relates to a twin sheet thermoformed plastic pallet which provides increased resistance to load induced deflection.

According to the invention, the plastic pallet includes a deck surface formed from at least two sheets of thermoformable plastic. One sheet of plastic is initially thermoformed to produce the upper surface of the deck having downwardly depending bosses of a generally non-linear, e.g. circular, configuration. These bosses are terminated in a boss floor at a predetermined depth from the surface of the deck. A second sheet of plastic is initially thermoformed to form the bottom surface of the deck. This sheet is thermoformed to include upwardly projecting bosses which terminate at a predetermined distance in a boss ceiling. During subsequent thermoforming, these sheets are fused together at the intersections of the boss floors with the boss ceilings. The sheets may also be fused together at other locations, e.g. a deck periphery. The structures formed by the downwardly depending and upwardly projecting bosses fused together provides a rigid reinforcement structure which resists deformation of the deck. The bosses are arranged on the surfaces of the deck so as not to form a symmetrical repeating pattern that encourages the propagation of bending or hinge moments along co-linearly arranged bosses. Bosses are placed in a nonuniform staggered arrangement that is not easily susceptible of being defined by linear patterns and hence, not easily capable of propagating bending moments, which tend to occur along relatively straight lines.

In another embodiment of the invention, the boss floors and boss ceilings are stepped. The stepped feature refers to the floor or ceiling of the boss being located on two separate planes connected by a substantially vertical wall. The corresponding ceiling or floor projecting from the other surface of the deck is correspondingly stepped to provide increased surface area contact between the boss floor and boss ceiling. The stepped construction provides additional surface area for fusion between the upper and lower deck surfaces resulting in greater bonding strength and increased resistance to load deflection. The step feature can also aid in registering the forming dies into alignment when forming the pallet. In addition to or in lieu of stepping the boss floor and boss ceiling intersection, the intersection may be placed at varying distance to the upper surface of the deck. The varying distances of the intersections to the deck upper surface further aids in resisting the formation of bending moments.

In an alternate embodiment of the invention, the bosses have a generally cylindrical cross section taken through the plane of the deck. The cylindrical cross section is intended to enhance the deflection resistant characteristics of the deck.

In an alternate embodiment of the invention, the arrangement of bosses consists of bosses of at least two distinct cross-sectional sizes. The arrangement of each size of bosses follows a generally non-collinear non-symmetrical placement.

In an alternate embodiment of the invention, one sheet of the deck is webbed upon itself and then fused to a second sheet for a stronger deck.

In an alternate embodiment of the invention, the lower surface of the deck has arcuately arranged material to act like the leafs of a spring to further resist deformation of the deck under load.

In another embodiment of the invention, the pallet deck may be supported by a plurality of legs integrally formed from the deck to elevate the deck above a support surface to allow the entry and removal of a fork or lift truck. The provision of upwardly opening legs also provides for the stacking or nesting of pallets to reduce storage space requirements when not in use.

DETAILED DESCRIPTION OF THE INVENTION

Figure 1:
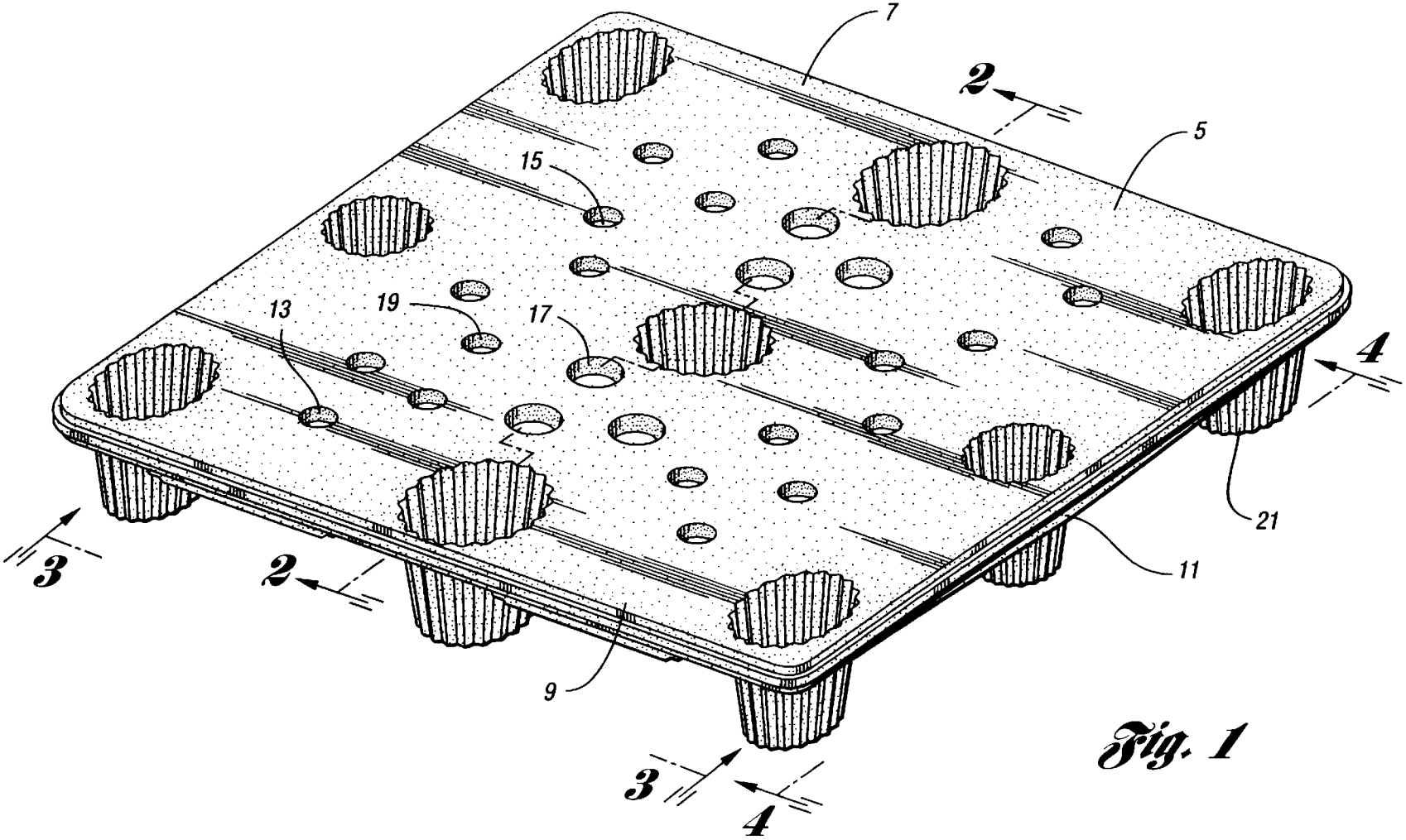
FIG. 1 is a perspective view of an embodiment of the invention.

FIG. 1 illustrates a prospective view of an embodiment of a pallet 5 according to the present invention. The pallet has a substantially planar deck 7 the deck is generally formed of two sheets of thermoplastic, upper sheet 9 which is used to form the upper surface of the deck, and lower sheet 11 which is used to form the lower surface of the deck. The two sheets may be fused together in a conventional twin sheet thermoforming process at the periphery of the deck to form a hollow structure.

As part of the thermoforming process, bosses 13 are formed in the upper surface of the deck depending downward towards the center of the deck terminating in boss floor 15. Corresponding bosses are located in the lower surface of the deck projecting upward towards the center of the deck. Bosses in the upper surface of the deck, and the corresponding bosses in the lower surface of the deck, can be of varying sizes. In a preferred embodiment, bosses will be of two general sizes, major bosses 17 and minor bosses 19, wherein a major boss has a cross sectional area (taken through the plane of the deck) substantially different from and preferably approximately twice that of a minor boss.

The pallet may also have a plurality of legs 21 formed from both upper sheet 9 and lower sheet 11 depending downwardly from deck 7. The legs should be upwardly opening to allow the pallets to nest when stacked.

Figure 2:
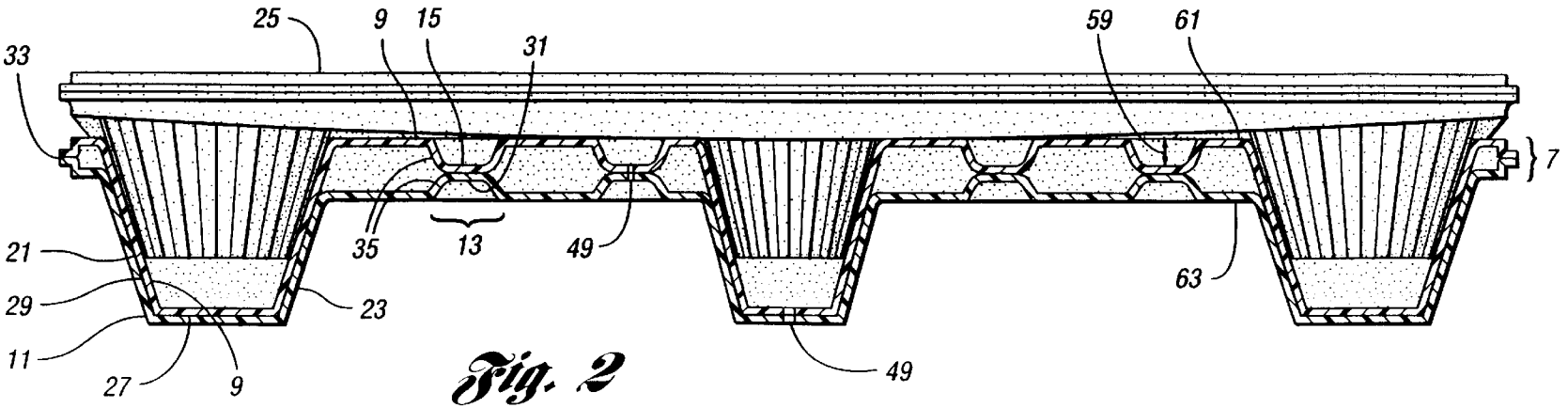
FIG. 2 is a cross sectional view taken along line 2—2 of the pallet of FIG. 1 in a stacked relationship underneath an unsectioned pallet.

Turning to FIG. 2, pallet 23 in cross section is shown stacked underneath pallet 25 (not sectioned). The stacking relation saves considerable space when the pallets are not in use or can be used to augment the strength of a single pallet. A stacking relationship is made possible by legs 21 being upwardly opened allowing insertion of the corresponding leg of another pallet of the same design. To maximize the strength, the two sheets 9, 11 which form the leg should be fused together preferably at base 27 of the leg and at leg sidewall 29.

Boss 13 is shown formed in the lower sheet 11 and projecting upwardly toward the center of the pallet terminating in boss ceiling 31. The corresponding boss structure is formed in upper sheet 9 of thermoformable material depending downwardly toward the center of the pallet terminating in boss floor 15. Boss ceiling 15 is fused to boss floor 31 during the twin sheet thermoforming operation. The two sheets of thermoformable material 9, 11 may also be fused at other locations including the periphery 33 of the pallet and the previously mentioned base 27 and leg sidewall 29. The transition of the upper and lower sheets 9, 11 to boss sidewalls 35 and then to fused boss ceilings and boss floors 15, 31 creates a truss structure which serves to stiffen or reinforce deck 7 of the pallet.

Figure 8:
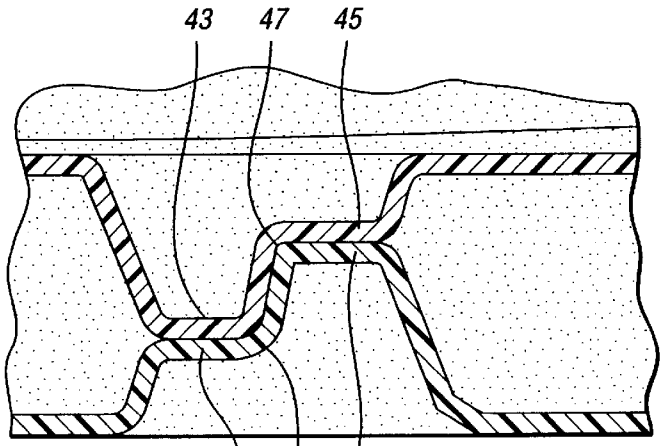
FIG. 8 is a cross sectional view of an alternative embodiment of area 8 of FIG. 2.

In a preferred embodiment, illustrated in FIG. 8, the boss floor may be stepped, i.e. the floor may be located in two distinct planes 27, 29 connected by relatively vertical wall 41. The corresponding boss structure in the lower sheet of material 11 will have a corresponding step, i.e. the ceiling will be found in two distinct planes 43, 40 connected by relatively vertical wall 47. The material in the boss floor will fuse to the corresponding material in the boss ceiling. The material in the relatively vertical walls 41, 47 will fuse together. The fusion of relatively vertical walls 41, 47 can be aided by including a small draft angle alpha, preferably on the order of five degrees. The stepped feature increases the area over which fusion takes place resulting in increased adherence between the upper and lower sheets 9, 11. The stepped feature also can serve as a registration guide to enhance the alignment between the upper and lower dies when fusing the upper and lower sheets 9, 11.

Figure 7:
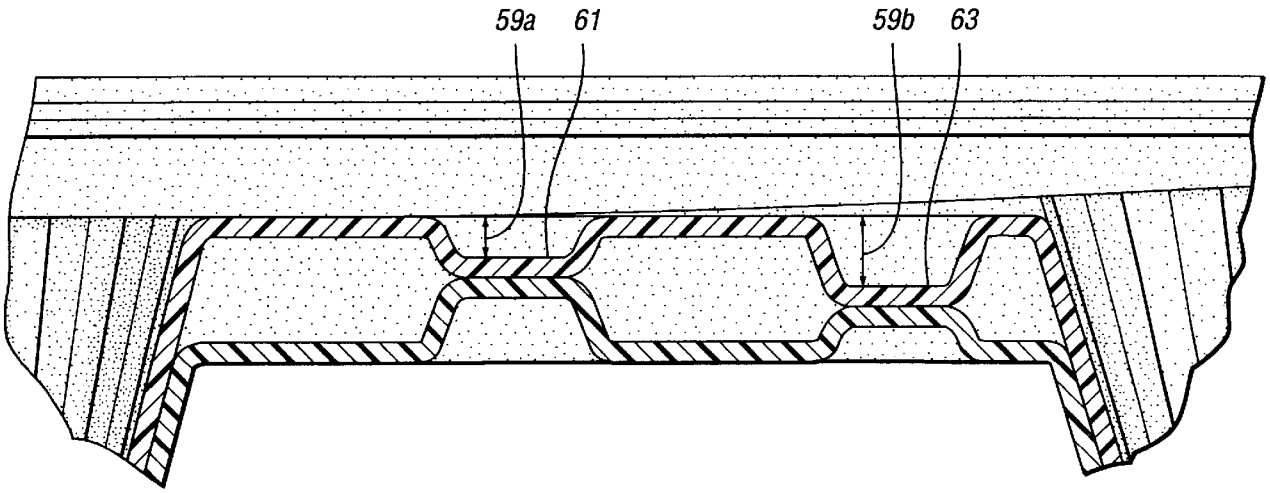
FIG. 7 is a cross sectional view of an alternative embodiment of the invention taken along the line 2—2.

The distance of the fused intersection of the boss ceiling with the boss floor from the deck surface may also be varied. Boss depth 59 will usually be midway between the upper surface of the deck 61 and the lower surface of the deck 63. FIG. 7 shows two bosses 61, 63 of varying boss height 59*a*, 59*b*. By varying boss depth 59, different stiffening characteristics of the bosses are created further resisting the creation of bending moments compared to boss arrangements using uniform boss depths.

Drain holes 49 may also be provided in the bosses and/or foot floors to aid in the drainage of fluids encountered in the pallet's work environment, such as rain water or spillage.

Figure 4:
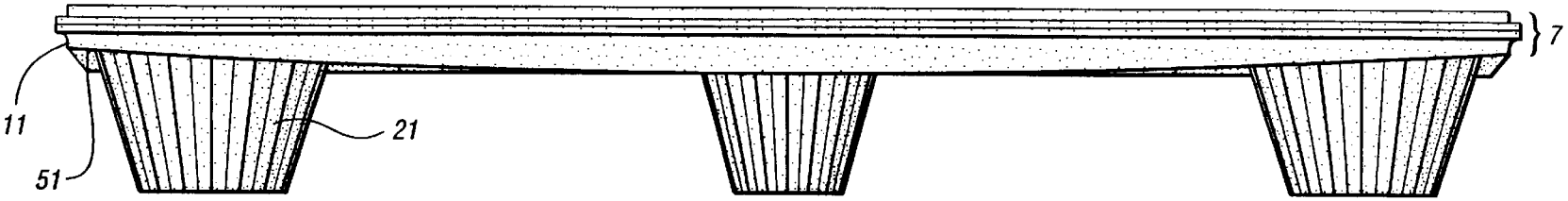
FIG. 4 is a side elevational view looking from line 4—4 of FIG. 1.

FIG. 4 illustrates a pallet according to the present invention viewed from the side along line 4—4 of FIG. 1. Lower sheet of material 11 includes leaf 51. The leaf is preferably an arcuate band formed in lower sheet 11 running the length of the pallet. The band is the approximate width of leg 21. The leaf acts like the leaf of a leaf spring to resist deformation of deck 7 under load.

Figure 3:
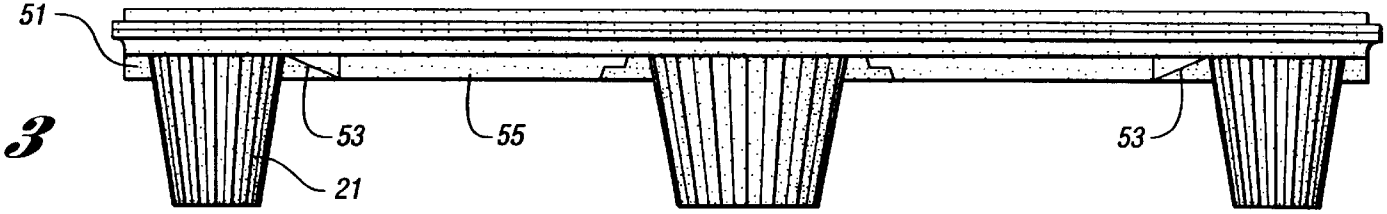
FIG. 3 is a side elevational view looking from line 3—3 of FIG. 1.

FIG. 3 illustrates a side view of the pallet taken along line 3—3 of FIG. 1. Leaf 51 as seen from the end is generally as wide as leg 21. Ramp 53 serves to transition the surface of leaf 51 to the non-leaf lower deck surface 55 so that the forks of a lift truck (not shown) are less likely to hang up on or puncture the pallet itself when inserted underneath the pallet such as during lifting operations or separating pallets that are nested.

Figure 5:
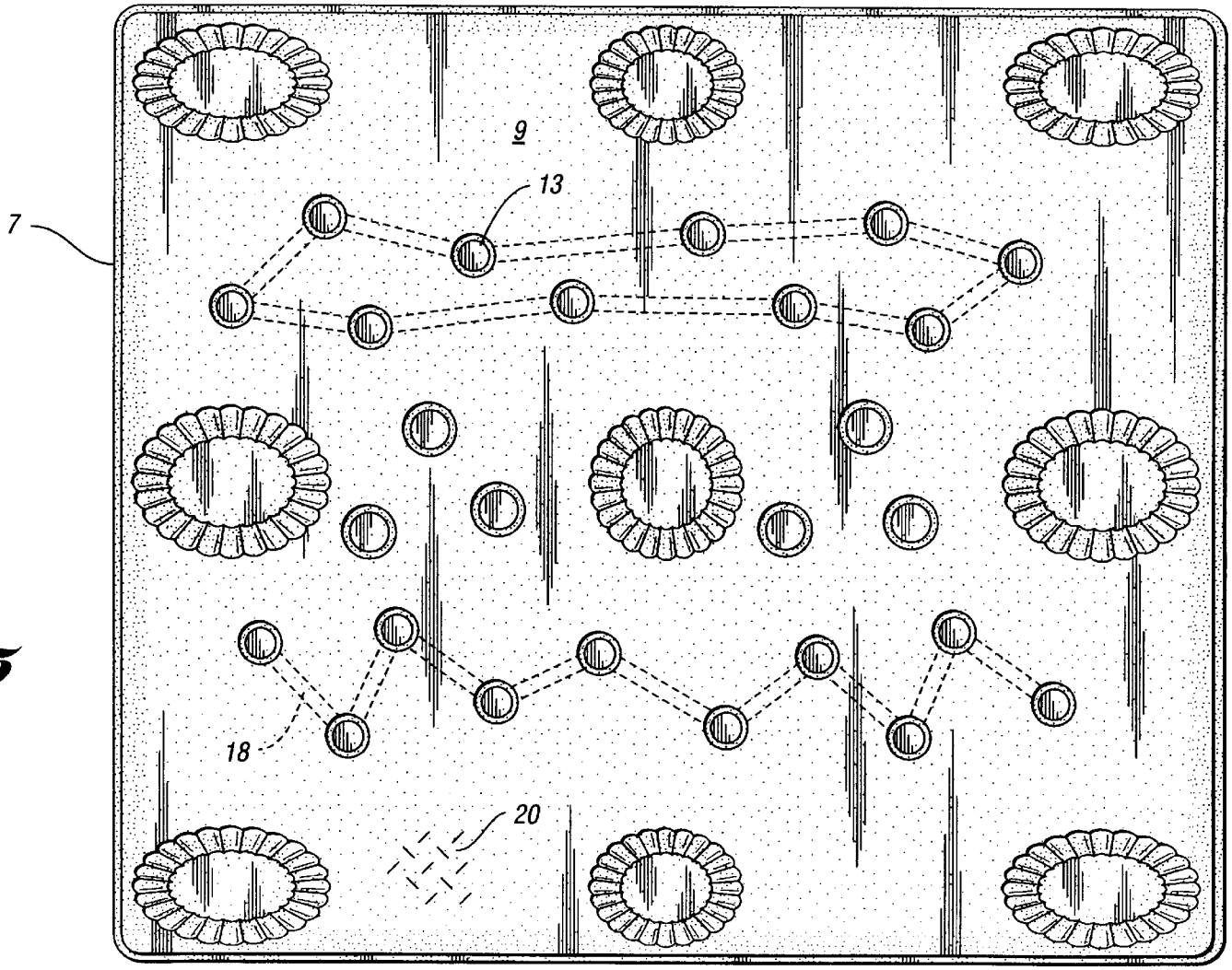
FIG. 5 is a top plan view of a further embodiment of a pallet according to the present invention.

FIG. 5 is a plan view of a pallet according to the present invention. Bosses 13 are arranged on upper surface 9 of deck 7 in an essentially non-linear pattern. The pattern substantially avoids formation of hinge or bending moments by avoiding linear arrangements of bosses. The pattern is non-symmetrical about either of the two major axes −X or −Y. In a preferred embodiment, the bosses are generally evenly distributed over the surface of the deck yet are not symmetrical about either of the X or Y axes. The arrangement of bosses may also be non-symmetrical about axes along the diagonals of the deck. A non-hinge forming arrangement may also be formed by locating bosses so that a line formed through the center of two adjacent bosses does not intersect the center of any boss adjacent to either of the line defining bosses. The pattern is, to some extent, random. Should random spacing result in substantially co-linear bosses, co-linear bosses should be moved to reduce the formation of hinge or bending moments.

Internal webbing 18 may be formed internally to the deck to further stiffen the deck. In one embodiment, one sheet of the deck can be webbed upon itself then fused to a second sheet, the webbing forming a rib internal to the deck for added stiffness. The webbing may be formed according to the methods disclosed in application Ser. No. 07/877,996 which is hereby incorporated by reference.

The deck of the pallet may also have surface finish 20 to reduce slippage of the product stacked on the pallet. In a preferred embodiment, the surface treatment comprises a pattern of diamond shaped raised surfaces and is thermoformed on the surface.

Figure 6:
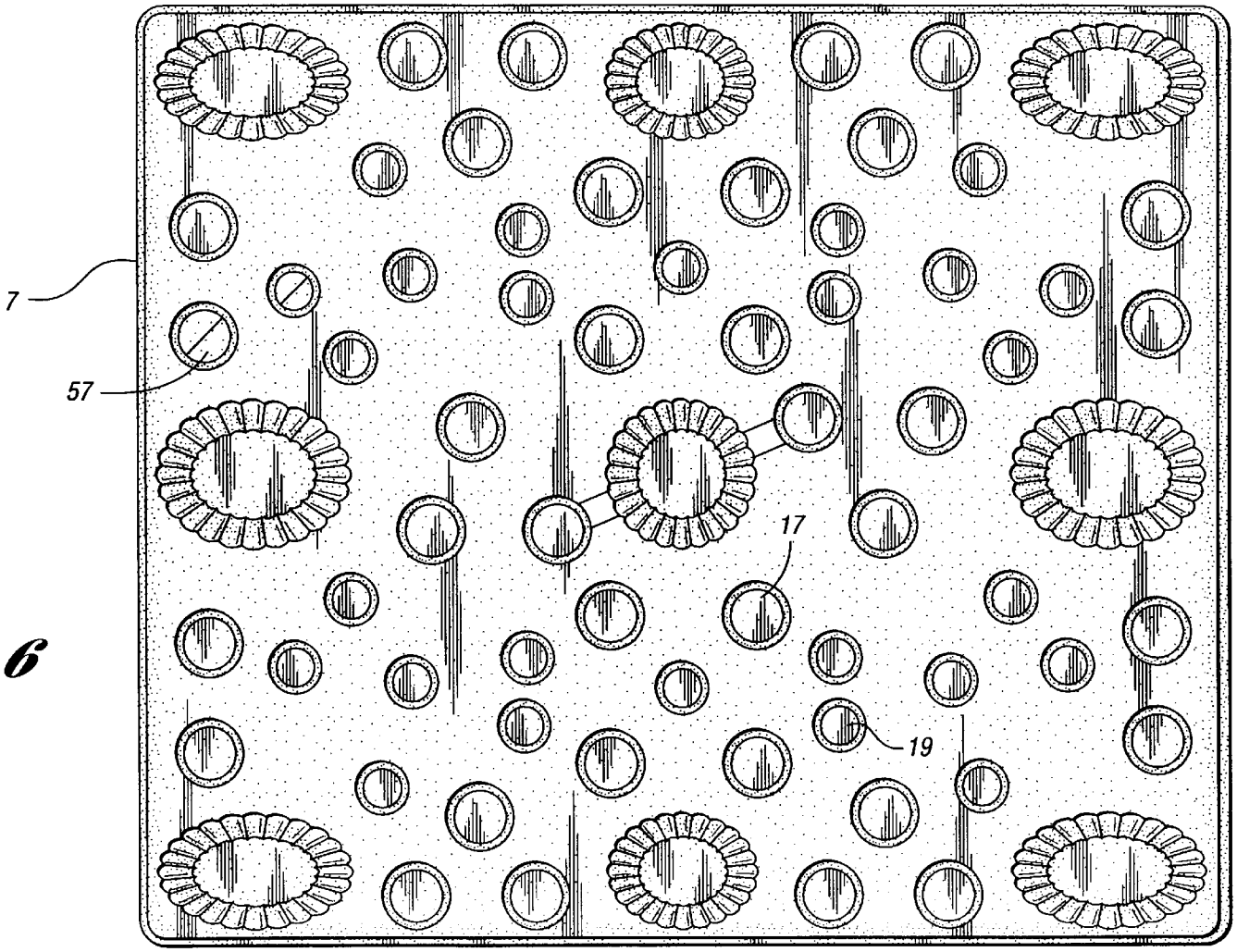
FIG. 6 is a top plan view of a further embodiment of a pallet according to the present invention.

Turning to FIG. 6, another embodiment of the invention is illustrated. Minor bosses 19 are arranged in a non-hinge forming pattern as are major bosses 17. Stepped boss floors 57 may be used in either arrangement of major and minor bosses 17, 19. In arrangements comprising major and minor bosses 17, 19, two adjacent bosses of the same size will define the line which should not intersect the boss center of the next adjacent boss, regardless of size, to form a non-hinge forming arrangement. The pattern should also not be symmetrical about axes going through the center of the deck.

EXAMPLE

Figure 9:
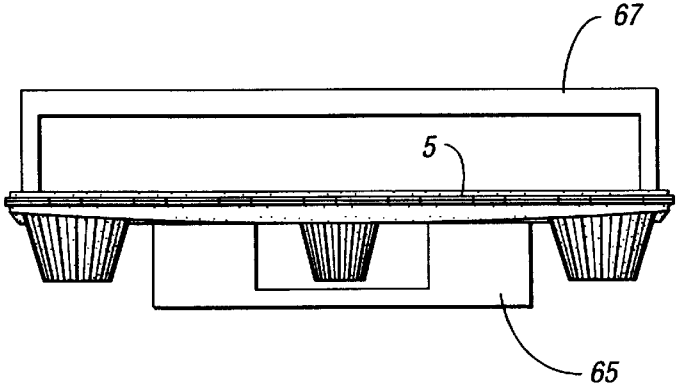
FIG. 9 is a side elevational view of an embodiment of the invention in a testing fixture.

A twin sheet pallet was thermoformed using an arrangement of bosses substantially as shown in FIG. 6. Upper and lower sheets were each 0.135" HDPE. The pallet was then subjected to a bending test as follows:

The pallet 5 was centered on a test rack 65 (FIG. 9). The height of the pallet above the surface 67 on which test rack 65 rests was then measured at the periphery of the pallet adjacent the eight outside legs. The pallet was then loaded with loading nose 67 at approximately 275 lbs. The deflection was then measured and recorded after 60 minutes by calculating the deflection (change in height) of the eight points adjacent the outset leg. The deflection at points adjacent the loading nose 67 were then averaged. Deflection at points not adjacent to the loading nose 67 were then averaged and subtracted from the average deflection of the legs adjacent the loading nose to determine the deflection of the pallet. Reported values reflect the average deflection of at least three samples.

The pallet of FIG. 6 showed a deflection of 0.771 inches after 60 minutes.

A pallet sold by Shuert Oakland Plastics and believed to be made according to U.S. Pat. No. 4,879,956 was subjected to an identical test. The sheet thickness of this pallet was estimated at approximately 0.125–0.130 inches. After 60 minutes this pallet showed 1.162 inches of deflection.

While preferred embodiments of the invention have been described herein, it will be appreciated that various modifications and changes may be made without departing from the spirit and scope of the appended claims.

What is claimed is:

1. A plastic pallet comprising:

a substantially rectangular, substantially planar load bearing deck member formed from an upper sheet of thermoplastic material and a lower sheet of thermoplastic material;

a first axis in the plane of said deck member extending through the center of said deck member running between two non-adjacent sides of said deck member;

a second axis extending through the center of said deck member in the plane of the deck member perpendicular to said first axis;

a plurality of generally non-linear bosses formed in said upper sheet of thermoplastic material depending downwardly to a predetermined depth defining a plurality of boss floors;

a plurality of generally non-linear bosses formed in said lower sheet of thermoplastic material projecting upwardly to a predetermined depth and defining a plurality of boss ceilings;

said upper and lower sheets of thermoplastic being fused at the intersection of said boss floors and said boss ceilings; and said bosses being arranged substantially non-symmetrically about one of said axes;

said boss floors and said boss ceilings further comprising stepped boss ceilings to fuse with correspondingly stepped boss floors.

2. The pallet according to claim 1 wherein said bosses are further arranged substantially non-symmetrically about both said first and said second axes.

3. The pallet of claim 1 wherein said bosses further comprise a mixture of major bosses and minor bosses, said major bosses having a cross sectional area that is not equal to the cross sectional area of said minor bosses.

4. The pallet of claim 3 further comprising a plurality of upwardly opening feet depending downwardly from said deck and formed from said upper and lower sheets of thermoplastic being fused together.

5. A plastic pallet comprising:

a substantially planar load bearing deck member formed from an upper and lower sheet of thermoplastic;

a plurality of bosses thermoformed in said upper sheet and depending to define a plurality of boss floors, a plurality of bosses formed in the lower sheet and projecting to define a plurality of boss ceilings, the bosses arranged in a non-symmetrical, non-hinge forming arrangement and;

a plurality of bosses thermoformed in said deck member whereby no more than three adjacent boss centers are colinear;

said bosses being further arranged in substantially non-linear distributions;

said boss floors and said boss ceilings further comprising stepped boss ceilings to fuse with correspondingly stepped boss floors.

* * * * *